US009721504B2

(12) United States Patent
Kim et al.

(10) Patent No.: US 9,721,504 B2
(45) Date of Patent: Aug. 1, 2017

(54) CURRENT SENSING CIRCUIT AND ORGANIC LIGHT EMITTING DIODE DISPLAY INCLUDING THE SAME

(71) Applicant: LG DISPLAY CO., LTD., Seoul (KR)

(72) Inventors: SangYun Kim, Seoul (KR); JunHyeok Yang, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 14/962,815

(22) Filed: Dec. 8, 2015

(65) Prior Publication Data

US 2016/0163261 A1 Jun. 9, 2016

(30) Foreign Application Priority Data

Dec. 9, 2014 (KR) ..... 10-2014-0176141

(51) Int. Cl.
*G09G 3/32* (2016.01)
*G09G 3/3233* (2016.01)
*G09G 3/3225* (2016.01)

(52) U.S. Cl.
CPC ..... *G09G 3/3233* (2013.01); *G09G 3/3225* (2013.01); *G09G 2320/0295* (2013.01); *G09G 2320/043* (2013.01); *G09G 2330/12* (2013.01)

(58) Field of Classification Search
CPC ..... G09G 3/3233; G09G 3/3241; G09G 3/325
See application file for complete search history.

(56) References Cited

U.S. PATENT DOCUMENTS 4,147,997 A * 4/1979 Greaves ..... H02J 1/02 330/107
4,855,618 A * 8/1989 Brokaw ..... G05F 3/267 323/315
2013/0127692 A1 5/2013 Yoon et al.
2014/0152642 A1 6/2014 Kim et al.
2014/0347253 A1 11/2014 Lee
2014/0347332 A1 11/2014 Lee

FOREIGN PATENT DOCUMENTS

EP 2 747 066 A1 6/2014

* cited by examiner

*Primary Examiner* — Gene W Lee
(74) *Attorney, Agent, or Firm* — Birch, Stewart, Kolasch & Birch, LLP

(57) ABSTRACT

Discussed are a current sensing circuit capable of compensating for degradation of an organic light emitting diode by sensing a current of the organic light emitting diode, and an organic light emitting diode display having the same. The current sensing circuit according to an embodiment includes a plurality of sensing modules configured to sense a pixel current from a display panel having an organic light emitting diode on each of a plurality of pixels, and to output a sensing voltage according to a sensing result; and an analog-to-digital converter configured to convert the sensing voltage into an analog-to-digital voltage, and to output sensing data.

18 Claims, 6 Drawing Sheets

CURRENT SENSING CIRCUIT AND ORGANIC LIGHT EMITTING DIODE DISPLAY INCLUDING THE SAME

CROSS-REFERENCE TO RELATED APPLICATION

Pursuant to 35 U.S.C. §119(a), this application claims the benefit of earlier filing date and right of priority to Korean Patent Application No. 10-2014-0176141, filed on Dec. 9, 2014, the contents of which is incorporated by reference herein in its entirety.

BACKGROUND OF THE INVENTION

Field of the Invention

The present invention relates to a current sensing circuit, and more particularly, to a current sensing circuit capable of compensating for degradation of an organic light emitting diode by stably sensing a current flowing on the organic light emitting diode, and to an organic light emitting diode display having the same.

Background of the Invention

Recently, various types of flat panel displays (FPDs) for reducing a large weight and large volume, and for addressing the disadvantages of a cathode ray tube, are being developed. Such flat panel displays include a liquid crystal display (LCD), a field emission display (FED), a plasma display panel (PDP), an organic light emitting diode (OLED) display, etc.

Among the flat panel displays, the OLED display has advantages such as a rapid response speed, high light-emitting efficiency, high brightness and a large viewing angle, by using a spontaneous light emitting diode which emits light spontaneously.

The OLED display is provided with an organic light emitting diode (OLED), a spontaneous light emitting device, as shown in FIG. 1. The organic light emitting diode includes an organic compound layer (HIL, HTL, EML, ETL, EIL) formed between an anode electrode and a cathode electrode.

The organic compound layer includes a hole injection layer (HIL), a hole transport layer (HTL), an emission layer (EML), an electron transport layer (ETL) and an electron injection layer (EIL). Once a driving voltage is applied to the anode electrode and the cathode electrode, holes passing through the hole transport layer (HTL) and electrons passing through the electron transport layer (ETL) move to the emission layer (EML) to form excitons. As a result, the emission layer (EML) generates visible rays.

The OLED arranges pixels each having the aforementioned organic light emitting diode in the form of matrices, and controls brightness of pixels selected by a gate signal based on a gray scale level of a data signal, thereby displaying an image.

FIG. 2 is an equivalent circuit of a single pixel of an organic light emitting diode display according to the related art.

As shown in FIG. 2, each pixel of the organic light emitting diode display includes an organic light emitting diode (OLED), a gate line (GL) and a data line (DL) crossing each other, a switching TFT (ST), a driving TFT (DT) and a storage capacitor (Cst). Each of the switching TFT (ST) and the driving TFT (DT) are implemented as a P-type MOSFET.

The switching TFT (ST) is turned on in response to a gate signal provided from the gate line (GL), and conducts a current path between a source electrode and a drain electrode. The switching TFT (ST) applies a data signal provided through the data line (DL) to the driving TFT (DT) and the storage capacitor (Cst) during a turned-on period.

The driving TFT (DT) controls a current flowing on the OLED, based on a voltage difference (Vgs) between a gate electrode and a source electrode. The storage capacitor (Cst) maintains a gate potential of the driving TFT (DT) constantly for a single frame.

The OLED is connected between a drain electrode and a basis voltage (VSS) of the driving TFT (DT), with a structure shown in FIG. 1.

In the OLED display having pixels, a brightness difference between the pixels may occur due to an electric characteristic difference of the driving TFT (DT), or a degradation difference of the OLED. Especially, the degradation difference of the OLED occurs due to a different degradation speed of each pixel when the OLED display is operated for a long time. If the degradation difference of the OLED becomes severe, image sticking occurs. This may cause a picture quality to be deteriorated.

SUMMARY OF THE INVENTION

Therefore, an aspect of the detailed description is to provide a current sensing circuit capable of compensating for degradation of an organic light emitting diode by sensing a current of the organic light emitting diode, and an organic light emitting diode display having the same.

To achieve these and other advantages and in accordance with the purpose of this specification, as embodied and broadly described herein, there is provided a current sensing circuit, including: a plurality of sensing modules configured to sense a pixel current from a display panel having an organic light emitting diode on each of a plurality of pixels, and to output a sensing voltage according to a sensing result; and an analog-to-digital converter configured to convert the sensing voltage into an analog-to-digital voltage, and to output sensing data.

To achieve these and other advantages and in accordance with the purpose of this specification, as embodied and broadly described herein, there is also provided an organic light emitting diode display, including: a display panel having a plurality of pixels, each pixel including an organic light emitting diode; a data driving unit having a current sensing circuit for outputting sensing data by sensing a pixel current from each of the plurality of pixels; and a timing controller configured to generate compensation image data by compensating for image data based on the sensing data, and to output the compensation image data to the data driving unit.

Effects

The current sensing circuit of the present invention can enhance operation reliability of the current integrator, by providing the current buffer at a front end of the current integrator, the current buffer for generating a stable sensing current regardless of noise due to degradation or a switching operation of the organic light emitting diode.

Thus, the organic light emitting diode display of the present invention can enhance a picture quality by preventing image sticking by compensating for degradation of the organic light emitting diode.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of preferred configurations of a current sensing circuit and an organic light emitting diode display including the same according to the present invention, with reference to the accompanying drawings.

Figure 1:
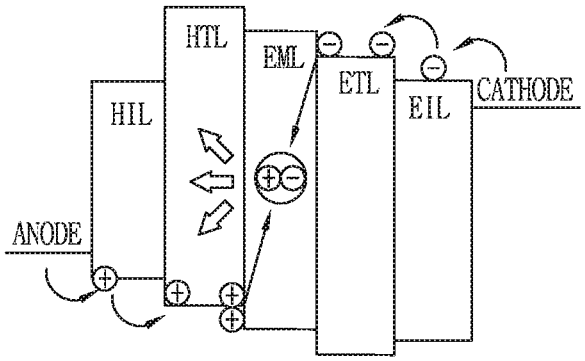
FIG. 1 RELATED ART
FIG. 1 is a view illustrating a light emitting principle of an organic light emitting diode display in accordance with a related art.
Figure 2:
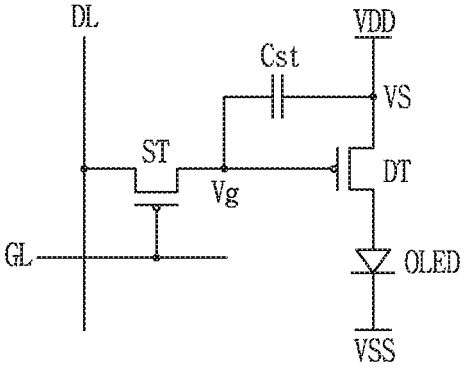
FIG. 2 RELATED ART
FIG. 2 is an equivalent circuit of a single pixel of an organic light emitting diode display in accordance with a related art.
Figure 3:
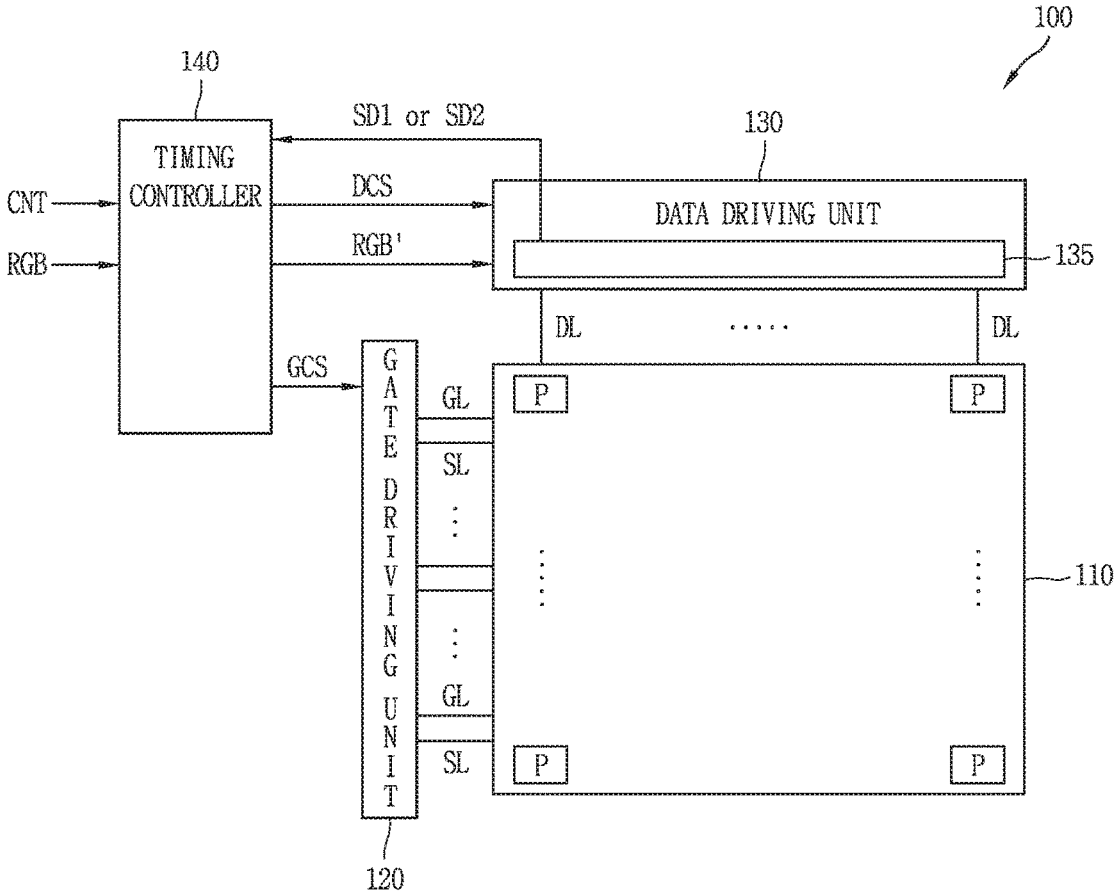
FIG. 3 is a view illustrating a configuration of an organic light emitting diode display according to an embodiment of the present invention.
Figure 4:
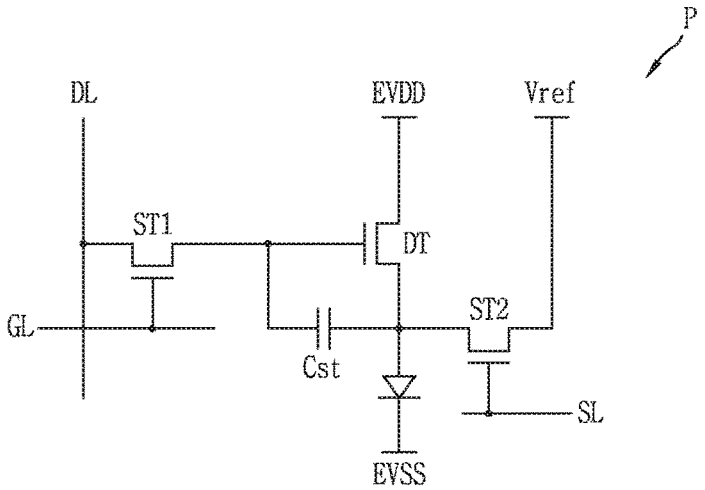
FIG. 4 is a view illustrating an example of an equivalent circuit of a pixel shown in FIG. 3.

FIG. 3 is a view illustrating a configuration of an organic light emitting diode display according to an embodiment of the present invention, and FIG. 4 is a view illustrating an example of an equivalent circuit of a pixel shown in FIG. 3.

Referring to FIG. 3, an organic light emitting diode display 100 according to an embodiment of the present invention may include a display panel 110, a gate driving unit 120, a data driving unit 130 and a timing controller 140. All the components of the organic light emitting diode display according to all the embodiments of the present invention are operatively coupled and configured.

A plurality of gate lines (GL) and a plurality of sensing lines (SL) may be formed to cross a plurality of data lines (DL) on the display panel 110, and pixels (P) may be formed at crossing regions in the form of matrices. The pixel (P) may be connected to a single gate line (GL), a single data line (DL) and a single sensing line (SL). A driving voltage (VDD) of a high potential and a reference voltage (Vref) of a high potential may be supplied to the pixel (P). The driving voltage (VDD) may be generated by a driving voltage source (not shown) as a predetermined level, and the reference voltage (Vref) may be generated by a reference voltage source (not shown) as a predetermined level.

Referring to FIG. 4, the pixel (P) may include an organic light emitting diode (OLED), a plurality of switching TFTs (ST1, ST2), a driving TFT (DT) and a storage capacitor (Cst). The plurality of switching TFTs (ST1, ST2) and the driving TFT (DT) may be implemented as an N-type MOSFET.

The OLED is connected between a drain electrode of the driving TFT (DT) and a basis voltage (VSS), and emits light by a current flowing between the driving voltage (VDD) and the basis voltage (VSS).

The first switching TFT (ST1) may output a data signal provided through the data line (DL) to a gate electrode of the driving TFT (DT), based on a gate signal provided through the gate line (GL).

The second switching TFT (ST2) may apply the reference voltage (Vref) to an anode electrode of the OLED, based on a sensing signal provided through the sensing line (SL).

The driving TFT(DT) is connected between the driving voltage (VDD) and the OLED, and may control the amount of current flowing to the OLED based on a voltage applied between the driving voltage (VDD) and the gate electrode.

The storage capacitor (Cst) is connected between a drain electrode of the first switching TFT (ST1) and the gate electrode of the driving TFT (DT). The storage capacitor (Cst) may maintain a voltage applied to the gate electrode of the driving TFT (DT), for a single frame.

Referring to FIG. 3, the gate driving unit 120 may generate a gate signal and a sensing signal based on a gate control signal (GCS) provided from the timing controller 140. The gate signal may be supplied to the plurality of gate lines (GL) of the display panel 110, and the sensing signal may be supplied to the plurality of sensing lines (SL) of the display panel 110. The gate driving unit 120 may be implemented as a shift register array, and may be formed on the display panel 110 as a gate in panel (GIP) type.

The data driving unit 130 may convert image data (e.g., compensation image data (RGB') output from the timing controller 140) into a data signal having an analog voltage form, based on a data control signal (DCS) provided from the timing controller 140. And the data driving unit 130 may supply the data signal to the plurality of data lines (DL).

The data driving unit 130 may further include a sensing circuit 135 for sensing a current flowing on each pixel (P), generating sensing data (SD) according to a sensing result, and outputting the sensing data (SD).

The timing controller 140 may generate a gate control signal (GCS) and a data control signal (DCS) from a control signal (CNT) input from an external system (not shown), and may output the generated signals. The control signal (CNT) input from the external system may include a vertical synchronization signal (Vsync), a horizontal synchronization signal (Hsync), a dot clock signal (DCLK), a data enable signal (DE), etc. The gate control signal (GCS) may be output to the gate driving unit 120, and the data control signal (DCS) may be output to the data driving unit 130.

The timing controller 140 may generate image data by converting an image signal (RGB). The timing controller 140 may generate and output compensation image data (RGB') by compensating for the image data, based on sensing data (SD) output from the sensing circuit 135 of the data driving unit 130. The timing controller 140 may generate the compensation image data (RGB') by adding or deducting the sensing data (SD) to or from the image data.

The compensation image data (RGB') may be output to the data driving unit 130 together with the data control signal (DCS).

Figure 5:
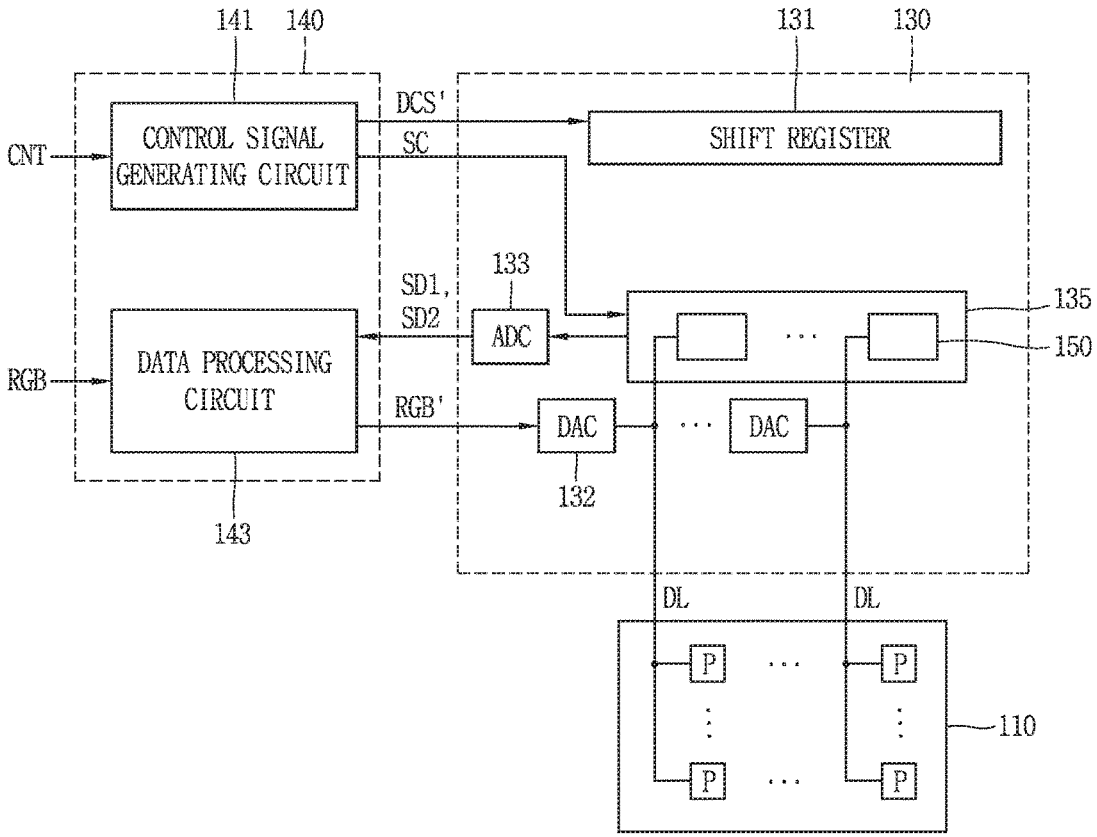
FIG. 5 is a view illustrating an example of a detailed configuration of a timing controller and a data driving unit shown in FIG. 3.

FIG. 5 is a view illustrating an example of a detailed configuration of the timing controller and the data driving unit shown in FIG. 3.

Referring to FIGS. 3 and 5, the timing controller 140 may include a control signal generating circuit 141 and a data processing circuit 143.

The control signal generating circuit 141 may generate and output the data control signal (DCS) for controlling an operation timing of the data driving unit 130, based on the control signal (CNT) input from the external system.

The control signal generating circuit 141 may generate and output a switching control signal (SC) for controlling an operation of the sensing circuit 135 of the data driving unit 130 to be explained later.

The data processing circuit 143 may extract a characteristic value (e.g., current-voltage) of the OLED based on the sensing data (SD) input from the data driving unit 130, and may determine a compensation value according to an extraction result. The data processing circuit 143 may compensate for a gray scale level of image data generated from the image signal (RGB) based on the compensation value, thereby generating and outputting the compensation image data (RGB'). Such a compensation image data (RGB') may be used to solve non-uniform brightness between the pixels (P) due to degradation of the OLED.

The data driving unit 130 may include the sensing circuit 135, a shift register 131, an analog-to-digital converter (ADC) 133, and a digital-to-analog converter (DAC) 132.

The sensing circuit 135 may include a plurality of sensing modules 150. The plurality of sensing modules 150 may be connected to the plurality of data lines (DL) of the display panel 110, in a one-to-one manner. The sensing modules 150 may be operated for a compensation operation period of the organic light emitting diode display 100, based on the switching control signal (SC) output from the timing controller 140, thereby sensing a pixel current of each pixel (P) of the display panel 110. The sensing modules 150 may output a sensing voltage according to a sensing result.

The ADC 133 may be commonly connected to the plurality of sensing modules 150. The ADC 133 may sample a sensing voltage output from the plurality of sensing modules 150, and may output the sampled sensing voltage after converting it into sensing data (SD) of a digital signal. The sensing data (SD) may be output to the timing controller 140. The ADC 133 may be provided in plurality so as to be connected to the plurality of sensing modules 150 in a one-to-one manner.

The shift register 131 may sequentially shift sampling signals with respect to the compensation image data (RGB') based on the data control signal (DCS) output from the timing controller 140.

The DAC 132 may be provided in plurality so as to be connected to the plurality of data lines (DL) in a one-to-one manner. The DAC 132 may convert the compensation image data (RGB') output from the timing controller 140 into a data signal, based on a sampling signal output from the shift register 131. The data signal is output to the data lines (DL) of the display panel 110.

Figure 6:
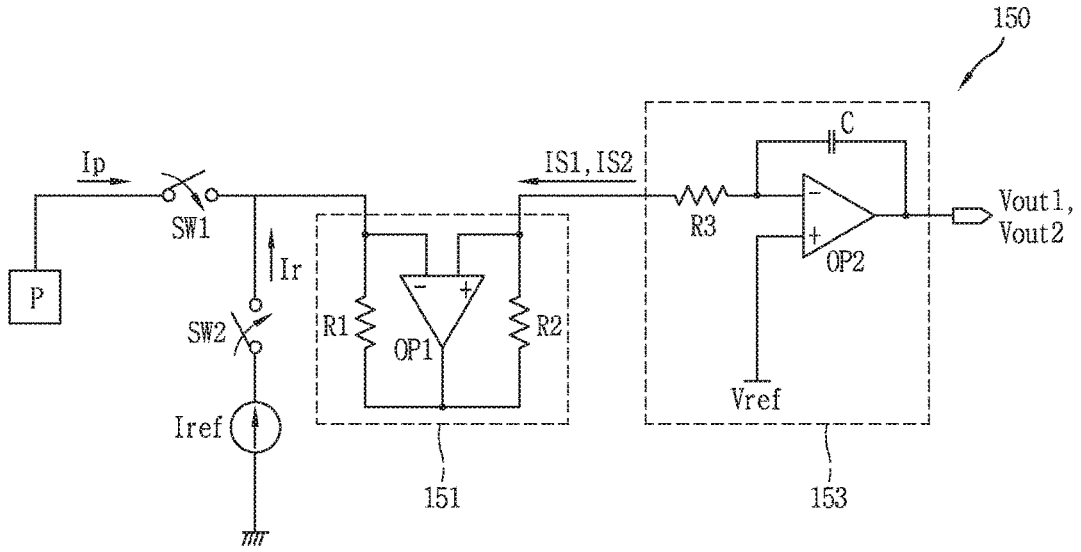
FIG. 6 is a view illustrating an embodiment of one of a plurality of sensing modules shown in FIG. 5

FIG. 6 is a view illustrating an embodiment of one of a plurality of sensing modules shown in FIG. 5.

Referring to FIGS. 5 and 6, the sensing module 150 may include a current buffer 151 and a current integrator 153.

The current buffer 151 may be connected to the pixel (P) of the display panel 110, e.g., the anode electrode of the OLED, through a first switch (SW1). The current buffer 151 may sense a pixel current (Ip) flowing on the OLED by a switching operation of the first switch (SW1), thereby generating a sensing current, e.g., a first sensing current (Is1).

The current buffer 151 may be connected to a reference current source (Iref) through a second switch (SW2). The current buffer 151 may generate a second sensing current (Is2) from a reference current (Ir) provided from the reference current source (Iref), by a switching operation of the second switch (SW2).

The first switch (SW1) and the second switch (SW2) are operated by the switching control signal (SC) provided from the timing controller 140. In this case, the first switch (SW1) and the second switch (SW2) may have different turn-on periods. The first switch (SW1) and the second switch (SW2) may be turned on for a compensation driving period of the organic light emitting diode display 100.

The current buffer 151 may include a first OPAMP (OP1), a first resistor (R1) and a second resistor (R2). Here, the term 'OPAMP' may refer to an operational amplifier.

The first OPAMP (OP1) may be composed of a first input terminal (−), a second input terminal (+) and an output terminal. The first input terminal (−) of the first OPAMP (OP1) may be connected to each pixel (P) through the first switch (SW1), or may be connected to the reference current source (Iref) through the second switch (SW2). The first resistor (R1) may be connected between the first input terminal (−) and the output terminal of the first OPAMP (OP1). The second input terminal (+) of the first OPAMP (OP1) may be connected to the current integrator 153 to be explained later. The second resistor (R2) may be connected between the second input terminal (+) and the output terminal of the first OPAMP (OP1).

The aforementioned current buffer 151 may be operated as a current mirror circuit. For instance, if the pixel current (Ip) is input to the first input terminal (−) of the first OPAMP (OP1) as the first switch (SW1) is turned on, a first sensing current (Is1) may be generated from the second input terminal (+) of the first OPAMP (OP1) according to a ratio between sizes of the first resistor (R1) and the second resistor (R2)

If the first resistor (R1) and the second resistor (R2) have the same size, the pixel current (Ip) and the first sensing current (Is1) may also have the same level. However, the level of the pixel current (Ip) may be very small according to a degradation degree of the OLED. As a result, the level of the first sensing current (Is1) generated from the current buffer 151 may be also very small. For a stable operation of the current integrator 153 to which the first sensing current (Is1) is input, the first sensing current (Is1) should have a larger level than the pixel current (Ip), and the first resistor (R1) should have a larger size than the second resistor (R2).

If the reference current (Ir) is input to the first input terminal (−) of the first OPAMP (OP1) as the second switch (SW2) is turned on, a second sensing current (Is2) may be generated from the second input terminal (+) of the first OPAMP (OP1) according to a ratio between the sizes of the first resistor (R1) and the second resistor (R2).

Likewise, if the first resistor (R1) and the second resistor (R2) have the same size, the reference current (Ir) and the second sensing current (Is2) may also have the same level. However, if noise is generated by a switching operation of the second switch (SW2), a current having a peak component due to the noise may be generated from the reference current (Ir). Such a current having a peak component may cause a large current difference on the reference current (Ir), resulting in a malfunction of the current integrator 153. For a stable operation of the current integrator 153 to which the second sensing current (Is2) is input, the second sensing current (Is2) should have a smaller level than the reference current (Ir), and the first resistor (R1) should have a smaller size than the second resistor (R2).

The current integrator 153, connected to the current buffer 151, may output a first sensing voltage (Vout1) and a second sensing voltage (Vout2) according to a sensing current generated from the current buffer 151, i.e., the first sensing current (Is1) and the second sensing current (Is2). The current integrator 153 may include a second OPAMP (OP2), a third resistor (R3) and a feedback capacitor (C).

The second OPAMP (OP2) may be composed of a first input terminal (−), a second input terminal (+) and an output terminal. The first input terminal (−) of the second OPAMP (OP2) may be connected to the current buffer 151 through the third resistor (R3). A current generated from the current buffer 151 may be input to the first input terminal (−) of the second OPAMP (OP2), in the form of a voltage. For instance, the first sensing current (Is1) may be input to the first input terminal (−) as a first voltage, by the third resistor (R3). And the second sensing current (Is2) may be input to the first input terminal (−) as a second voltage, by the third resistor (R3). A reference voltage (Vref) may be input to the second input terminal (+) of the second OPAMP (OP2). And the feedback capacitor (C) may be connected between the output terminal and the first input terminal (−) of the second OPAMP (OP2).

The aforementioned current integrator 153 may output the first sensing voltage (Vout1) based on the first sensing current (Is1) generated from the current buffer 151, and may output the second sensing voltage (Vout2) based on the second sensing current (Is2) generated from the current buffer 151.

The ADC 133 of the data driving unit 130 may generate and output first compensation data (SD1) based on the first sensing voltage (Vout1), and may generate and output second compensation data (SD2) based on the second sensing voltage (Vout2). The first compensation data (SD1) may be data for compensating for a gray scale level of a data signal according to a degradation degree of the OLED, and the second compensation data (SD2) may be data for compensating for a gray scale level of a data signal according to a size of the feedback capacitor (C) of the current integrator 153.

The timing controller 140 may generate compensation image data (RGB') based on the first sensing data (SD1) and the second sensing data (SD2). The compensation image data (RGB') may be output to the data lines (DL) of the display panel 110 through the DAC 132 of the data driving unit 130.

As aforementioned, the sensing module 150 according to one embodiment includes the current integrator 153, and the current buffer 151 disposed at a front end of the current integrator 153, and operated as a current mirror circuit by being composed of an OPAMP and a resistor. With such a configuration, the current integrator 153 is stably operated by a sensing current generated from the current buffer 151. This may enhance reliability in operation. Further, the current integrator 153 may have a stable operation by controlling a ratio between resistors inside the current buffer 151, and then by controlling a level of the sensing current.

Figure 7:
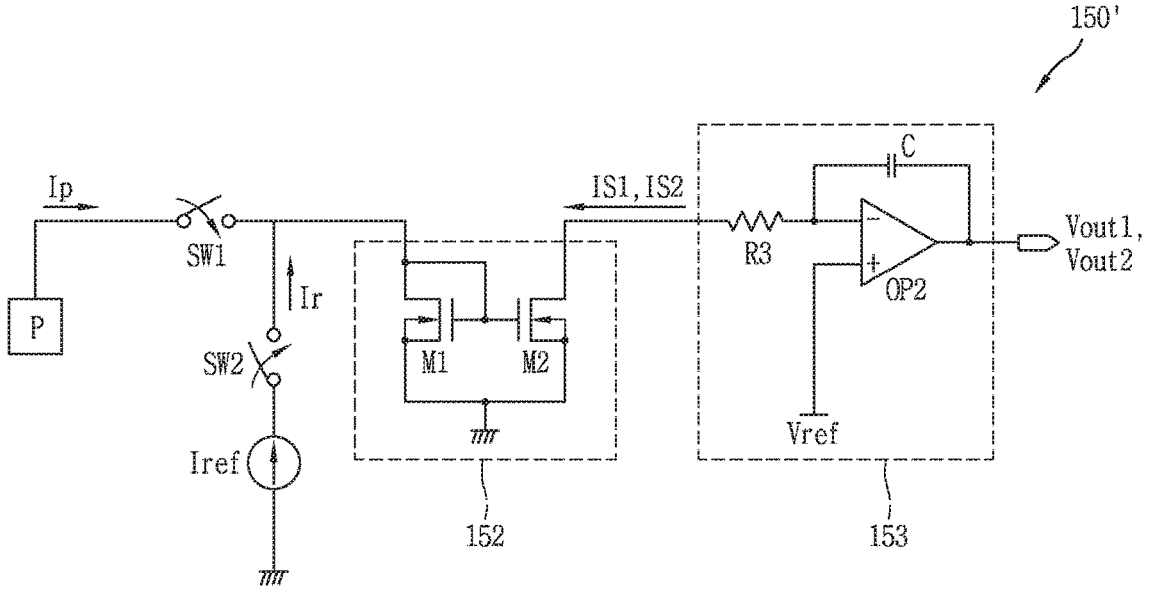
FIG. 7 is a view illustrating another embodiment of one of the plurality of sensing modules shown in FIG. 5.

FIG. 7 is a view illustrating another embodiment of one of the plurality of sensing modules shown in FIG. 5.

A sensing module 150' according to another embodiment has the same configuration as the sensing module 150 shown in FIG. 6, except for the current buffer 152. Thus, the same components will have the same reference numerals, and detailed explanations thereof will be omitted or brief.

Referring to FIGS. 5 and 7, the sensing module 150' may include a current buffer 152 and a current integrator 153.

The current buffer 152 may sense a pixel current (Ip) from each pixel (P) of the display panel 110 through a first switch (SW1), thereby generating a first sensing current (Is1). And the current buffer 152 may generate a second sensing current (Is2), by receiving a reference current (Ir) from a reference current source (Iref), through a second switch (SW2).

The current buffer 152 may include a first switching device (M1) and a second switching device (M2). The first switching device (M1) and the second switching device (M2) may be implemented as an N-type MOSFET.

A gate electrode and a drain electrode of the first switching device (M1) may be connected to the pixel (P) through the first switch (SW1), or may be connected to the reference current source (Iref) through the second switch (SW2). A gate electrode of the second switching device (M2) may be connected to the gate electrode of the first switching device (M1), and a drain electrode of the second switching device (M2) may be connected to a first input terminal (−) of the current integrator 153. Source electrodes of the first switching device (M1) and the second switching device (M2) may be commonly connected to a ground (GND).

The aforementioned current buffer 152 may be operated as a current mirror circuit. A level of the pixel current (Ip) and the first sensing current (Is1) or the reference current (Ir) and the second sensing current (Is2) may be variable according to a ratio between sizes (areas) of the first switching device (M1) and the second switching device (M2).

As aforementioned, since the first sensing current (Is1) should have a larger level than the pixel current (Ip), the first switching device (M1) is preferably formed to have a smaller size than the second switching device (M2). Further, since the second sensing current (Is2) should have a smaller level than the reference current (Ir), the first switching device (M1) is preferably formed to have a larger size than the second switching device (M2).

The current integrator 153, connected to the current buffer 151, may output a first sensing voltage (Vout1) and a second sensing voltage (Vout2) based on a sensing current generated from the current buffer 151, i.e., the first sensing current (Is1) and the second sensing current (Is2). The current integrator 153 may include a second OPAMP (OP2), a third resistor (R3) and a feedback capacitor (C).

The ADC 133 of the data driving unit 130 may generate and output first compensation data (SD1) based on the first sensing voltage (Vout1), and may generate and output second compensation data (SD2) based on the second sensing voltage (Vout2).

The timing controller 140 may generate compensation image data (RGB') based on the first sensing data (SD1) and the second sensing data (SD2). The compensation image data (RGB') may be output to the data lines (DL) of the display panel 110 through the DAC 132 of the data driving unit 130.

As aforementioned, the sensing module 150' according to another embodiment includes the current integrator 153, and the current buffer 151 disposed at a front end of the current integrator 153, and operated as a current mirror circuit by being composed of switching devices. With such a configuration, the current integrator 153 is stably operated by a sensing current generated from the current buffer 151. This may enhance reliability in operation. Further, the current integrator 153 may have a stable operation by controlling a ratio between areas of the switching devices inside the current buffer 151, and then by controlling a level of the sensing current.

Figure 8:
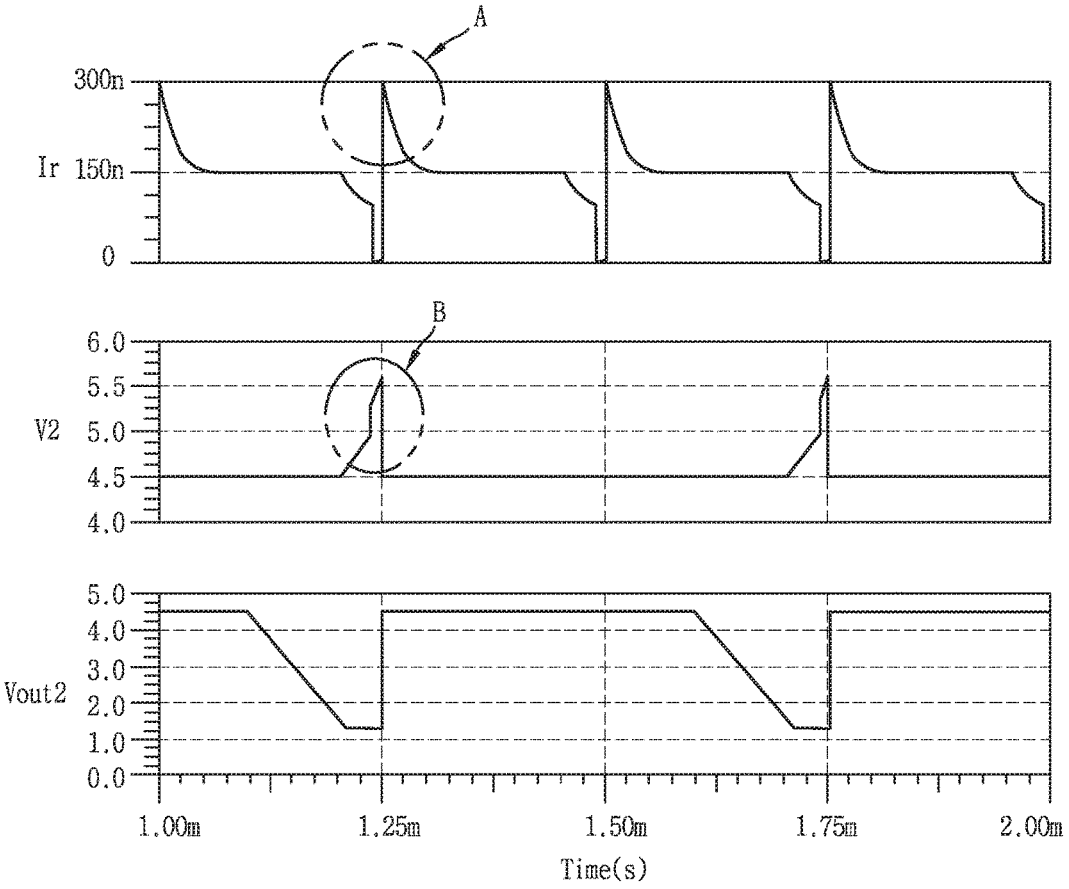
FIGS. 8 and 9 are timing views showing an operation of a sensing circuit according to a related art and a sensing circuit according to an embodiment of the present invention, respectively.
Figure 9:
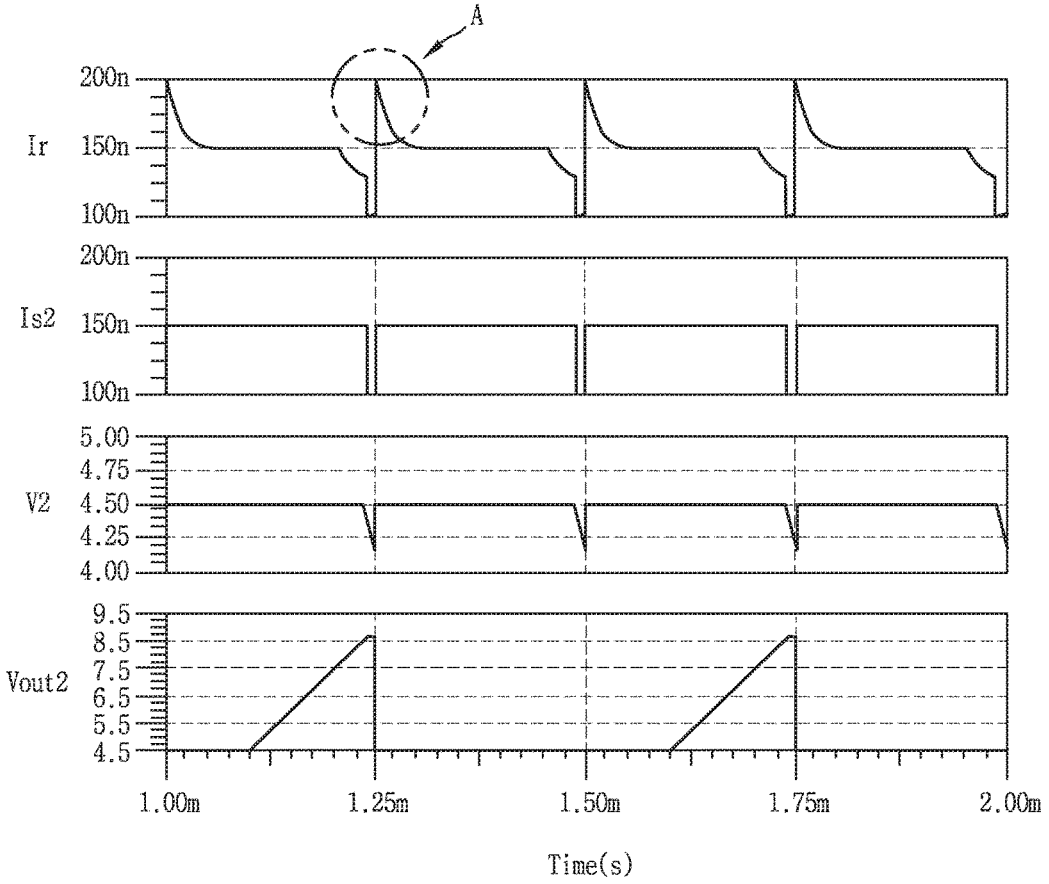

FIGS. 8 and 9 are timing views showing an operation of a sensing circuit according to a related art and a sensing circuit according to an embodiment of the present invention, respectively.

As shown in FIGS. 8 and 9, the reference current (Ir) output from the reference current source (Iref) has noise (A) due to a switching operation of the second switch (SW2). Such noise (A) should be removed because it may cause a malfunction of the current integrator.

As shown in FIG. 8, since the noise (A) occurred from the reference current (Ir) on the conventional sensing circuit is not removed, a peak component (B) occurs from a voltage input to the current integrator, e.g., a second voltage (V2). The current integrator may have an unstable operation due to the voltage having the peak component (B), and this may reduce a level of the output voltage (Vout2). As a result, performance of the sensing circuit is lowered, and it may be impossible to compensate for degradation of the organic light emitting diode display.

On the other hand, as shown in FIG. 9, in the sensing circuit 135 of the present invention, the second sensing current (Is2) having noise removed therefrom may be output from the reference current (Ir), by the current buffer 151 of the sensing module 150. As a result, the second voltage input to the current integrator 153 does not have a peak component.

The current integrator 153 may output the second sensing voltage (Vout2) based on the reference voltage (Vref) and the second voltage (V2). The second sensing voltage (Vout2) may be output to increase up to a predetermined level.

That is, in the sensing circuit 135 of the present invention, noise (A) of the reference current (Ir) is removed from the current buffer 151. Accordingly, the second voltage (V2) input to the current integrator 153 may have a predetermined level, and thus the current integrator 153 may be stably operated.

As aforementioned, even if the reference current (Ir) having a large peak component is input from the reference current source (Iref), the second sensing current (Is2) of a small level may be generated by controlling a resistor size of the current buffer 151. This may allow the current integrator 153 to be stably operated.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A current sensing circuit, comprising:

a plurality of sensing modules configured to sense a pixel current from a display panel having an organic light emitting diode on each of a plurality of pixels, and to output a sensing voltage according to a sensing result; and an analog-to-digital converter configured to convert the sensing voltage into sensing data of a digital signal, wherein each of the plurality of sensing modules includes:

a current buffer configured to generate a sensing current by sensing the pixel current; and a current integrator configured to output the sensing voltage by receiving the sensing current as a voltage, and wherein the current buffer includes:

a first operational amplifier including a first input terminal configured to receive one of the pixel current via a first switch and a reference current via a second switch, a second input terminal connected to the current integrator, and an output terminal, a first resistor connected between the first input terminal and the output terminal, and a second resistor connected between the second input terminal and the output terminal.

2. The current sensing circuit of claim 1, wherein the first resistor has a smaller size than the second resistor to reduce noise generated by a switching operation of the second switch.

3. The current sensing circuit of claim 1, wherein the current buffer controls a level of the sensing current by controlling a ratio between sizes of the first and second resistors.

4. The current sensing circuit of claim 1, further comprising a reference current source configured to provide the reference current by being connected to the current buffer.

5. The current sensing circuit of claim 1, wherein the current buffer is a current mirror circuit.

6. The current sensing circuit of claim 1, wherein the current integrator includes:

a resistor connected to the current buffer;

a second operational amplifier composed of a first input terminal to which the voltage by the sensing current is input through the resistor, a second input terminal to which a reference voltage is input, and an output terminal from which the sensing voltage is output; and a capacitor connected between the first input terminal and the output terminal of the second operational amplifier.

7. The current sensing circuit of claim 1, wherein the first switch is disposed between the current buffer and the organic light emitting diode, and wherein as the first switch is turned on in a compensation driving period of the display panel, the sensing voltage is output through the current integrator.

8. An organic light emitting diode display comprising:

a display panel including a plurality of pixels, each pixel including an organic light emitting diode (OLED); and a current sensing circuit including a plurality of sensing modules, wherein each sensing module is configured to sense a pixel current from the display panel, and to output a sensing voltage according to a sensing result, wherein each sensing module includes:

a current buffer configured to generate a sensing current by sensing the pixel current from the display panel; and a current integrator configured to output the sensing voltage based on the sensing current, and wherein the current buffer includes:

a first switching device having a gate electrode directly connected to a drain electrode, the gate electrode being configured to receive one of the pixel current via a first switch and a reference current via a second switch; and a second switching device having a gate electrode connected to the gate electrode of the first switching device, and having a drain electrode connected to the current integrator, and wherein source electrodes of the first and second switching devices are commonly connected to a ground.

9. The organic light emitting diode display of claim 8, wherein the current buffer controls a level of the sensing current by controlling a ratio between sizes of the first and second switching devices.

10. The organic light emitting diode display of claim 8, wherein the first and second switching devices are implemented with an N-type transistors.

11. An organic light emitting diode display, comprising:

a display panel having a plurality of pixels, each pixel including an organic light emitting diode;

a data driving unit having a current sensing circuit for outputting sensing data by sensing a pixel current from each of the plurality of pixels; and a timing controller configured to generate compensation image data by compensating for image data based on the sensing data, and to output the compensation image data to the data driving unit, wherein the current sensing circuit includes:

a plurality of sensing modules configured to sense the pixel currents and to output a sensing voltage according to a sensing result; and an analog-to-digital converter configured to convert the sensing voltage into sensing data of a digital signal and to output the sensing data, wherein each of the plurality of sensing modules includes:

a current buffer configured to generate a sensing current by sensing the pixel current; and a current integrator configured to output the sensing voltage by receiving the sensing current as a voltage, and wherein the current buffer includes a first operational amplifier including a first input terminal configured to receive one of the pixel current via a first switch and a reference current via a second switch, a second input terminal connected to the current integrator, and an output terminal.

12. The organic light emitting diode display of claim 11, wherein the current sensing circuit is operated at a compensation driving period of the display panel.

13. The organic light emitting diode display of claim 11, wherein the current buffer further includes:

a first resistor connected between the first input terminal and the output terminal, and a second resistor connected between the second input terminal and the output terminal, and wherein the first resistor has a smaller size than the second resistor to reduce noise generated by a switching operation of the second switch.

14. The organic light emitting diode display of claim 13, wherein the current buffer controls a level of the sensing current by controlling a ratio between sizes of the first and second resistors of the current buffer.

15. The organic light emitting diode display of claim 11, further comprising a reference current source configured to provide the reference current by being connected to the current buffer.

16. The organic light emitting diode display of claim 11, wherein the current buffer is a current mirror circuit.

17. The organic light emitting diode display of claim 11, wherein the current integrator includes:

a resistor connected to the current buffer;

a second operational amplifier composed of a first input terminal to which the voltage by the sensing current is input through the resistor, a second input terminal to which a reference voltage is input, and an output terminal from which the sensing voltage is output; and a capacitor connected between the first input terminal and the output terminal of the second operational amplifier.

18. The organic light emitting diode display of claim 11, wherein the first switch is disposed between the current buffer and the organic light emitting diode, and wherein as the first switch is turned on in a compensation driving period of the display panel, the sensing voltage is output through the current integrator.

* * * * *